US009683723B2

(12) United States Patent
Heggemann et al.

(10) Patent No.: US 9,683,723 B2
(45) Date of Patent: Jun. 20, 2017

(54) LIGHTING ARRANGEMENT FOR LIGHTING THE INTERIORS OF TOWERS AND TUNNELS

(71) Applicant: Weidmueller Interface GmbH & Co. KG, Detmold (DE)

(72) Inventors: Christian Heggemann, Detmold (DE); Daniel Muether, Detmold (DE); Michael Gerkens, Bielefeld (DE); Hans Schlingmann, Horn-Bad Meinberg (DE)

(73) Assignee: Weidmueller Interface GmbH & Co. KG (DE)

( * ) Notice: Subject to any disclaimer, the term of this patent is extended or adjusted under 35 U.S.C. 154(b) by 418 days.

(21) Appl. No.: 14/097,454

(22) Filed: Dec. 5, 2013

(65) Prior Publication Data

US 2014/0168969 A1 Jun. 19, 2014

(30) Foreign Application Priority Data

Dec. 14, 2012 (DE) ..... 20 2012 104 882 U
Apr. 11, 2013 (DE) ..... 10 2013 103 673

(51) Int. Cl.
*F21V 15/01* (2006.01)
*F21S 4/10* (2016.01)
(Continued)

(52) U.S. Cl.
CPC ..... *F21V 15/01* (2013.01); *F21S 4/10* (2016.01); *F21V 7/0066* (2013.01); *F21V 23/06* (2013.01);
(Continued)

(58) Field of Classification Search
CPC ..... F21V 15/01; F21S 4/001–4/008
(Continued)

(56) References Cited

U.S. PATENT DOCUMENTS 6,425,678 B1 7/2002 Verdes et al.
8,275,489 B1 * 9/2012 Devine ..... F03D 9/003 290/44
(Continued)

FOREIGN PATENT DOCUMENTS

DE 94 17 300 U1 4/1996
DE 100 29 069 A1 1/2002
(Continued)

*Primary Examiner* — Jong-Suk (James) Lee
*Assistant Examiner* — Christopher E Dunay
(74) *Attorney, Agent, or Firm* — Laubscher, Spendlove & Laubscher, P.C.

(57) ABSTRACT

A lighting arrangement for illuminating a passage, such as a wind tower or tunnel, includes at least one lighting unit having a generally rectangular base with bottom, side and end walls cooperating to define an open-topped chamber, a pair of light energy sources arranged partially in the housing chamber for directing light beams toward opposite ends of the housing, respectively, and a cover member formed of light-transmitting material, which cover member is connected with the base to extend over the light energy sources and to close the housing chamber. The cover member includes a concave dome portion containing a cavity within which the light sources are mounted. Opposite areas of the cover dome portion define collimating devices for concentrating the light beams in opposite directions longitudinally of the passage that is to be illuminated. A plurality of lighting units are longitudinally-arranged in the passage, and are electrically connected in series.

5 Claims, 2 Drawing Sheets

(51) Int. Cl.

| | |
|---|---|
| *F21V 7/00* | (2006.01) |
| *F21V 23/06* | (2006.01) |
| *F21W 131/101* | (2006.01) |
| *F21W 131/411* | (2006.01) |
| *F21Y 101/00* | (2016.01) |

(52) U.S. Cl.
CPC . *F21W 2131/101* (2013.01); *F21W 2131/411* (2013.01); *F21Y 2101/00* (2013.01)

(58) Field of Classification Search
USPC ..... 362/235, 653
See application file for complete search history.

(56) References Cited

U.S. PATENT DOCUMENTS

| | | | | |
|---|---|---|---|---|
| 2005/0024877 | A1* | 2/2005 | Frederick | F21S 4/001 362/277 |
| 2005/0190553 | A1 | 9/2005 | Lynch et al. | |
| 2005/0221659 | A1* | 10/2005 | Mrakovich | F21S 4/001 439/404 |
| 2006/0083017 | A1 | 4/2006 | Wang et al. | |
| 2009/0034267 | A1 | 2/2009 | Hung | |
| 2011/0058370 | A1* | 3/2011 | Datz | B60Q 1/2611 362/235 |
| 2012/0069561 | A1 | 3/2012 | Burton et al. | |
| 2013/0039063 | A1* | 2/2013 | Quaal | F21S 4/001 362/235 |
| 2013/0148350 | A1* | 6/2013 | Yriberri | F21V 5/04 362/235 |
| 2013/0176735 | A1* | 7/2013 | Kobayashi | F21S 4/001 362/249.02 |
| 2013/0329425 | A1* | 12/2013 | Lowes | H01L 33/502 362/235 |
| 2014/0218910 | A1* | 8/2014 | Mitchell | F21V 23/009 362/235 |

FOREIGN PATENT DOCUMENTS

| | | | |
|---|---|---|---|
| DE | 10 2010 048 547 | A1 | 4/2012 |
| DE | 10 2010 060 424 | A1 | 5/2012 |
| EP | 2 284 438 | A1 | 2/2011 |
| JP | 2002 157914 | A | 5/2001 |

* cited by examiner

Fig.2a
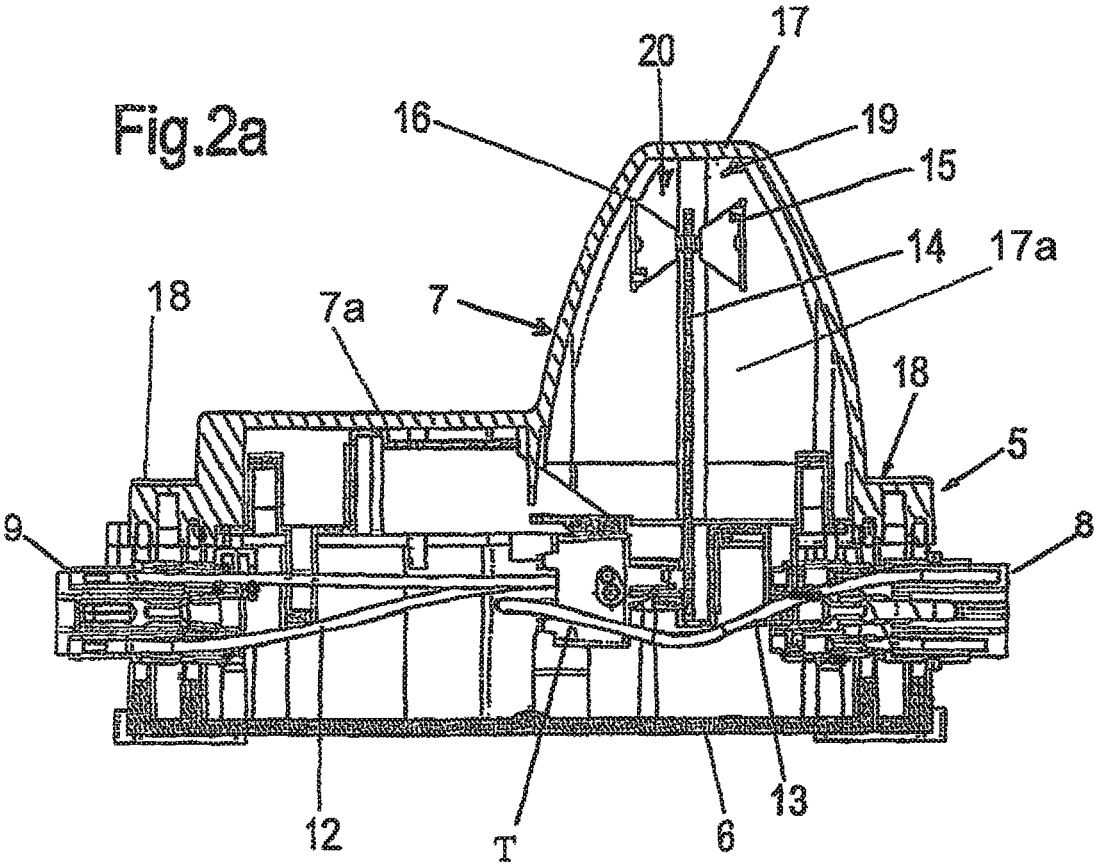
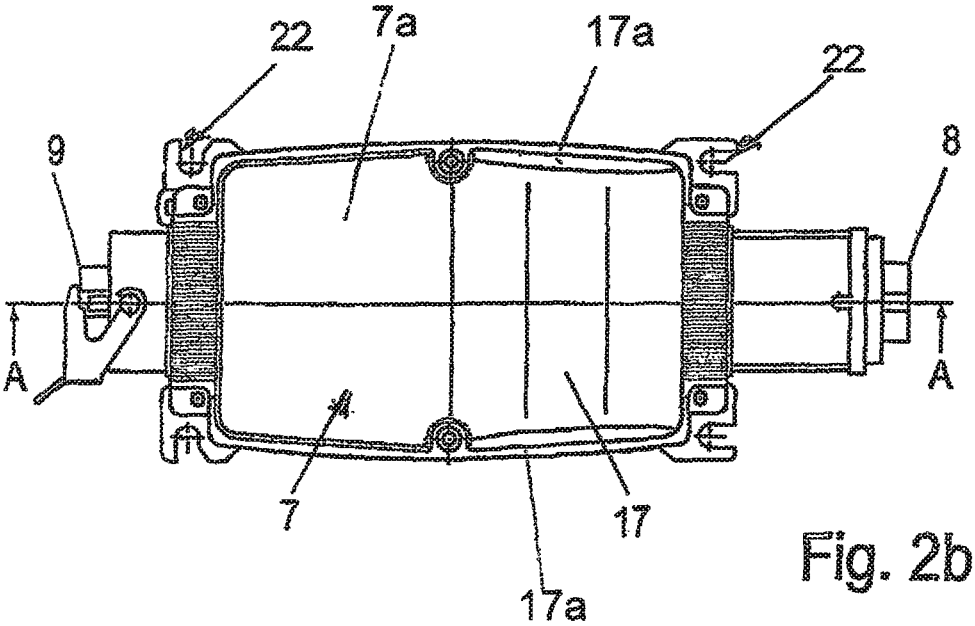
Fig. 2b

LIGHTING ARRANGEMENT FOR LIGHTING THE INTERIORS OF TOWERS AND TUNNELS

REFERENCE TO RELATED APPLICATIONS

This application corresponds with and claims priority of the German applications Nos. DE 20 2012 104 882.5 filed Dec. 14, 2012, and DE 10 2013 103 673.2 filed Apr. 11, 2013.

BACKGROUND OF THE INVENTION

Field of the Invention

A lighting arrangement for illuminating a passage, such as a wind tower or tunnel, includes at least one lighting unit having a generally rectangular base with bottom, side and end walls cooperating to define an open-topped chamber, a pair of light energy sources arranged partially in the housing chamber for directing light beams toward opposite ends of the housing, respectively, and a cover member formed of light-transmitting material, which cover member is connected with the base to extend over the light energy sources and to close the housing chamber. The cover member includes a concave dome portion containing a cavity within which the light sources are mounted. Opposite areas of the cover dome portion define collimating devices for concentrating the light beams in opposite directions longitudinally of the passage that is to be illuminated. A plurality of lighting units are longitudinally-arranged in the passage, and are electrically connected in series.

Description of Related Art

Various types of lighting arrangements have been proposed in the prior art for lighting passages, such as the interiors of towers or tunnels. Lighting devices and lighting arrangements, for example for the tower of a wind power installation, are in fact already known in and of themselves. However, the designs that are known only meet the requirement to a limited degree for a satisfactory illumination of the interior of the tower, particularly since with existing lighting arrangements, often a relatively large number of lighting devices are needed which unnecessarily raises the expenditures for installation and maintenance as well as for energy consumption.

Therefor, the present invention was developed to provide an improved lighting arrangement that requires only a small expenditure in terms of equipment, whereby with only a relatively few lighting devices, the interior of the tower is satisfactorily illuminated.

SUMMARY OF THE INVENTION

Accordingly, a primary object of the invention is to provide a lighting arrangement for illuminating a passage, such as a wind tower or tunnel, including at least one lighting unit having a generally rectangular base with bottom, side and end walls cooperating to define an open-topped chamber, a pair of light energy sources arranged partially in the housing chamber for directing light beams toward opposite ends of the housing, respectively, and a cover member formed of light-transmitting material, which cover member is connected with the base to extend over the light energy sources and to close the housing chamber. The cover member includes a concave dome portion containing a cavity within which the light sources are mounted.

According to another object, opposite areas of the cover dome portion define collimating devices for concentrating the light beams in opposite directions longitudinally of the passage that is to be illuminated.

According to a further object, a plurality of lighting units are longitudinally-arranged in the passage, and are electrically connected in series.

A more specific object of the invention is to provide means for supplying electrical energy to said light energy sources, a pair of connectors mounted in openings contained in the housing end walls, respectively, a conductive printed circuit board arranged at least partially in said housing chamber normal to said bottom wall, said printed circuit board having a first end supported by said housing, and a second end extending into said dome cavity, said light energy sources being supported by, and electrically connected with, said printed circuit board second end. A plurality of conductor means are electrically connected at one end with said printed circuit board one end, said conductor means extending through said connectors, respectively, for connection with a voltage source.

BRIEF DESCRIPTION OF THE DRAWINGS

Other objects and advantages of the invention will become apparent from a study of the following specification, when viewed in the light of the accompanying drawing, in which:

FIG. 2*a* is a vertical sectional view of one of the lighting units of FIG. 1, taken along line A-A of FIG. 2*b*; and FIG. 2*b* is a top view of a the lighting unit of FIG. 2*a*.

DETAILED DESCRIPTION OF THE INVENTION

Figure 1:
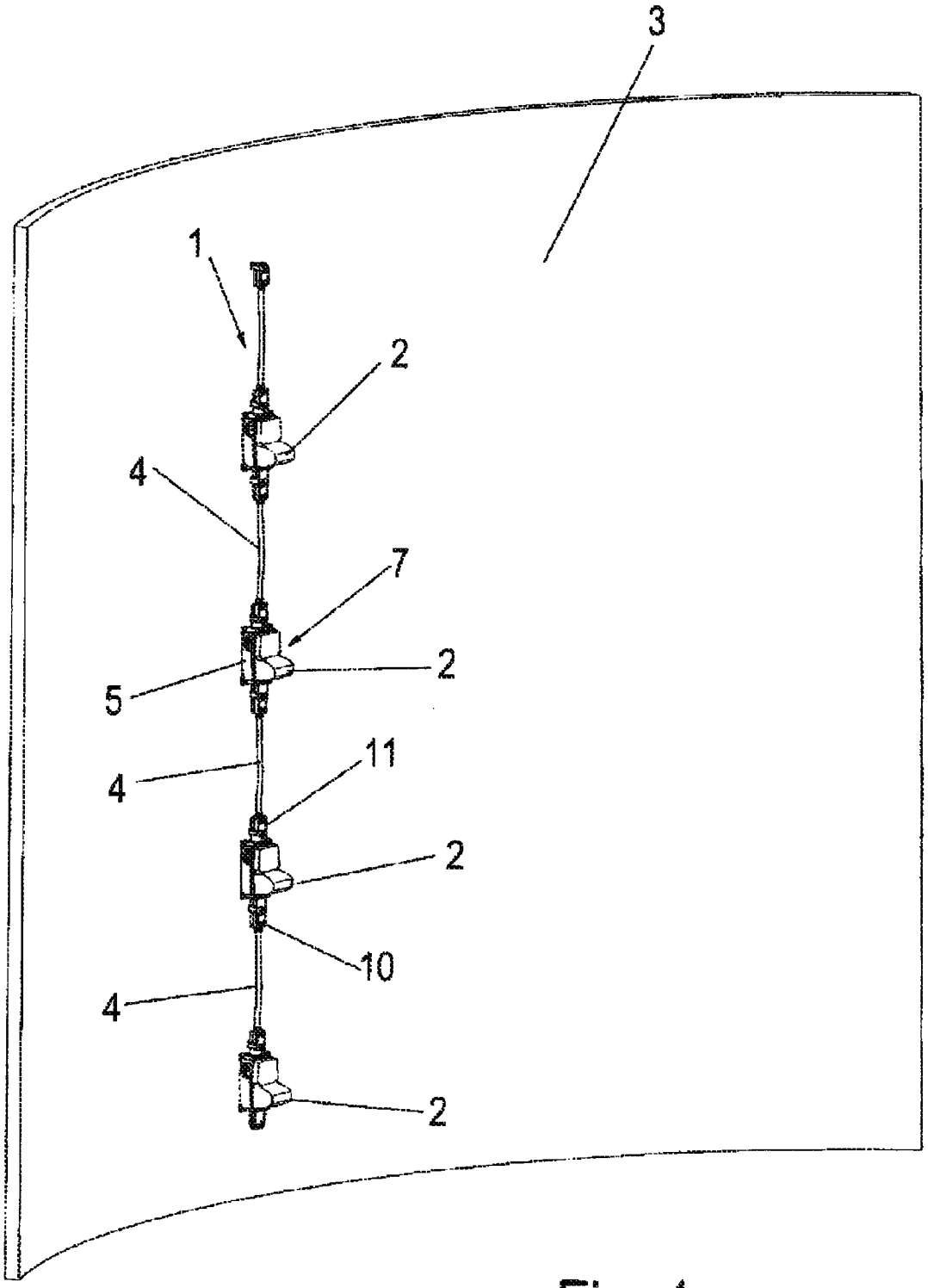
FIG. 1 is a plan view of the lighting arrangement of the present invention mounted on the inner surface of a vertical wind power generating tower.

Referring first more particularly to FIG. 1, a preferred lighting arrangement 1 includes two or more lighting units 2 that are arranged in longitudinally-spaced relation on the inner surface 3 of a tower, specifically, a tower of wind-power-driven electricity generating station. The lighting units are connected in series by conductor segments 4.

Each lighting device 2 comprises a housing 5 having a base 6 with horizontal bottom wall and vertical side and end walls that cooperate to define an open-topped chamber. A cover 7 formed of light-conducting transparent material includes a first portion 7*a* extending parallel to the base bottom wall, and a longitudinally arranged convex projecting dome portion 17 containing a cavity, which cover closes the top of the housing chamber. As shown in FIGS. 2*a* and 2*b*, the dome portion 17 has in longitudinal cross-section a generally inverted U-shaped configuration, with a pair of generally planar side walls 17*a*. The cover 7 is fastened to the base 6 by a plurality of corner fastening connections 18. An intermediate frame may optionally be provided between the housing parts. Preferably, but not necessarily, the housing 5 comprises a configuration that in top plan view is essentially oblong, and preferably rectangular.

Referring to FIG. 2*a*, the base 6 includes a pair of end walls that contain openings in which are mounted male pin connector 8 and female socket connector 9, respectively. The contacts of the connectors are adapted for connection with the associated ends of the conductor segments 4 of FIG. 1. Internal conductors 12 and 13 connect the connector contacts with the input terminals of a transformer T which has output terminals connected with the lower end of a printed circuit board 14. The printed circuit board 14 is supported at its lower end by the base 6 and extends normal to the bottom wall of the base 6 upwardly within the dome portion 17 of the transparent cover 7. Alternatively, a wire could also be connected directly to a clamp in the housing, or tapping could take place to a wire that passes through.

Mounted on the upper end of the printed circuit board are a pair of light energy sources 15 and 16 that are oppositely directed to transmit light energy toward opposite ends of the housing 5. The bases 6 are provided with wall-fastening screw-receiving brackets 22 (FIG. 2*b*) by means of which the lighting units 2 may be mounted in longitudinally-spaced relation on the passage inner wall surface, as shown in FIG. 1. Thus, the light beams from the sources 15 and 16 of each of the lighting units 2 are directed in directions 180° from each other longitudinally of the passage contained within the wind-operated power generating tower. In other words, the lighting devices 2 or their housings 5 are arranged with suitable means such as screws or a similar means to the interior wall 3 of the tower in such a way that the light from the lighting means 15, 16 of each lighting unit 2 shines upwardly on one side, and downwardly on the other side.

Particularly suitable as the lighting means 15 and 16 are light emitting diodes (LEDs) which, in spite of their compact construction and low energy consumption, nevertheless generate an intense beam of light that can be well focused. It is advantageous to assign optical devices, such as collimators 19 and 20, to each of the light energy sources 15 and 16, whereby the light energy of each source is focused and/or bundled, such that the beam of light essentially shines well bundled into the interior space of the tower. As is known in the art, these optical collimator devices may be advantageously integrated directly into the housing cover 7.

Still to be mentioned is the fact that in this case, a projecting dome 17 (in the sense of an attachment that projects vertically out of the profile of the housing cover) is formulated in the housing cover in an advantageous manner, into which the circuit board 14 with the lighting means 15 and 16 projects, whereby the lighting means 15 and 16 with the collimators 19 and 20, respectively, each lie slightly below the walls of this dome which in any case are light-transmissive section-by-section.

One or more of the conductor segments 4 are electrically connected to a suitable power supply of the wind power generating tower, for example, to a electrical control panel. On the whole, a suitable electrical circuit is realized in such a way that the illumination devices and the wire pieces belong to it.

In an advantageous arrangement of the lighting device 2, it comprises an integrated voltage transformer that is installed ahead of the lighting means 15 and 16, thereby permitting operation of the lighting device 2 in a broad input-output voltage range. The input voltage range especially advantageously ranges from approximately 24 volts to an output of up to approximately 280 volts, whereby a supply can be provided with direct current and/or alternating current.

In an additional embodiment, it can furthermore be provided that various supply voltage connections to the lighting device 2 are present to which different types of voltage (direct current or alternating current) and/or different voltage ranges are assigned. Should the situation arise, then in that case a plurality of voltage transformers are integrated. The various supply voltage connections may be linked with different types of operation of the lighting device 2; for example, a first supply voltage connection for a normal operation of the lighting device 2, and a second supply voltage connection for emergency operation or safety operation with a reduced power input. The second supply voltage connection may then, for example, be connected with an uninterruptible power supply unit (UPS).

According to the state of the art, lighting arrangements for wind power generating towers are frequently operated with a direct current of 24 volts which is fed into the lighting arrangement at the base of the tower. With a tower height that can amount to 100 m (meters) or more, a comparatively large conductor cross section of at least approximately 6 $mm^2$ (square millimeters) is necessary for the wires that connect the lighting devices so that in spite of the voltage drop in the wires, lighting devices that are arranged in the upper area of the tower still have available a sufficiently high voltage for their operation.

As a result of the broad operating voltage range with the cited advantageous arrangement of the lighting device 2 according to the application, a feed can take place at the base of the tower with a voltage that lies within the upper segment of the operating voltage range, for example with 120 volts. As a result of the higher voltage, smaller currents are already sufficient for the operation of the lighting devices 2 than with a feed of 24 V. The voltage drop in the wire segments 4 is therefore also relatively small with a small cross-section of the conductor. In addition, the cross-section of the conductor for the wire segments 4 can be selected as so small that a voltage drop all the way to the lower end of the operating voltage range (and thus, for example, 24 volts) is harmless to the lighting device 2 that is arranged at the upper end of the tower. Thus the lighting arrangement 1 can be operated with a significantly lower cross section of the conductor, with the wire segments 4 completely able to function over the entire height of the tower (or the entire length of the tunnel). As a result of the lighting arrangement according to the application, it becomes possible to illuminate the interior space of a tower with simple means and only a few of the lighting devices in such a way that it can be scaled on a ladder without danger.

Within that context, the beams or columns of light from the lighting means and the wire sections 4 extend parallel to each other, whereby what is understood in the sense of this step is that they extend exactly parallel to each other or at an angle that correspondingly deviates from the parallel lines (or, in this case, the vertical lines) by less than 15°. A slight deviation of the beam of light from the parallel direction ("approximately parallel") in that way can be advantageous to keep the possible glare on a person who is climbing up the tower as low as possible.

While in accordance with the provisions of the Patent Statutes the preferred forms and embodiments of the invention have been illustrated and described, it will be apparent to those skilled in the art that changes may be made without deviating from the invention described above.

What is claimed is:

1. A lighting arrangement for illuminating a longitudinal passage comprising:

a plurality of lighting units arranged in longitudinally-spaced relation in the passage; and a plurality of generally linear collinearly-arranged electrical conductor segments connecting said lighting units in series, each of said lighting units including:

a housing comprising a generally rectangular base having a bottom wall, a pair of opposed parallel side walls formed orthogonal to the bottom wall, and a pair of opposed end walls formed orthogonal to the bottom wall and side walls, said walls cooperating to define an open-topped housing chamber;

a cover member formed of light-transmitting material, said cover member being connected with said base to close said housing chamber, said cover member including:

a first cover portion arranged in spaced relation above said bottom wall; and a convex dome cover portion longitudinally arranged relative to said first cover portion and extending outwardly away from said bottom wall, said convex dome cover portion having in a longitudinal cross-section a generally inverted U-shape configuration, and a pair of generally planar side walls, thereby to define a dome cavity communicating with said housing chamber;

a pair of light energy sources arranged at least partially in said dome cavity for generating and directing light beams toward opposite ends of said housing, respectively;

collimating means for concentrating said light beams as columns of light extending in opposite directions substantially parallel with said electrical conductor segments and longitudinally of the passage, said collimating means being defined by opposed portions of said convex dome cover portion; and an arrangement for supplying electrical energy to said light energy sources, comprising:

a pair of connectors mounted in openings contained in said end walls, respectively;

a conductive printed circuit board arranged at least partially in said housing chamber normal to said bottom wall, said printed circuit board having a first end supported by said housing, and a second end extending into said dome cavity, said light energy sources being supported by, and electrically connected with, said printed circuit board second end; and a plurality internal conductors electrically connected between said printed circuit board first end and said connectors, thereby to afford connection of the printed circuit board with a voltage source via said internal conductors and said connectors.

2. A lighting arrangement as defined in claim 1, and further including mounting means (22) for mounting said base on the interior wall surface (3) of the passage.

3. A lighting arrangement as defined in claim 1, wherein said electrical energy supply means includes a transformer (T) mounted in said housing chamber, said transformer being electrically connected between said connectors and said printed circuit board.

4. A lighting arrangement as defined in claim 3, wherein said transformer is operable to step up the lower voltage of said voltage source to a higher voltage for operating said light energy sources.

5. A lighting arrangement as defined in claim 4, wherein said transformer is operable to convert an input alternating current voltage of about 24 volts to an output alternating current voltage of between about 120 volts to about 280 volts.

* * * * *